US011638943B2

(12) United States Patent
Lin et al.

(10) Patent No.: US 11,638,943 B2
(45) **Date of Patent: *May 2, 2023**

(54) METHOD FOR MANUFACTURING COLD-FORGED, EXTRUDED ALUMINUM ALLOY TUBE

(71) Applicant: JIN YUNCHENG ENTERPRISE CO., LTD., Taichung (TW)

(72) Inventors: Kun-Tzu Lin, Taichung (TW); Yi-Siang Lin, Taichung (TW)

(73) Assignee: Jin Yuncheng Enterprise Co., Ltd., Taichung (TW)

( * ) Notice: Subject to any disclaimer, the term of this patent is extended or adjusted under 35 U.S.C. 154(b) by 511 days.

This patent is subject to a terminal disclaimer.

(21) Appl. No.: 16/733,459

(22) Filed: Jan. 3, 2020

(65) Prior Publication Data

US 2020/0324328 A1 Oct. 15, 2020

(30) Foreign Application Priority Data

Apr. 9, 2019 (TW) ..... 108112355
Dec. 10, 2019 (TW) ..... 108145162

(51) Int. Cl.
*B21C 1/22* (2006.01)
*B21C 1/00* (2006.01)
(Continued)

(52) U.S. Cl.
CPC ..... *B21C 1/003* (2013.01); *B21C 1/22* (2013.01); *C22F 1/043* (2013.01); *C22F 1/053* (2013.01)

(58) Field of Classification Search
CPC .. B21C 1/00; B21C 1/003; B21C 1/16; B21C 1/22; B21C 23/00; B21C 23/002;
(Continued)

(56) References Cited

U.S. PATENT DOCUMENTS 4,132,662 A * 1/1979 Sturwold ..... C10M 129/02 508/505
6,453,714 B2 * 9/2002 Kido ..... B21D 41/02 72/370.04
(Continued)

FOREIGN PATENT DOCUMENTS

CN 106269979 A * 1/2017 ..... B21C 37/06
GB 1110530 A * 4/1968
(Continued)

OTHER PUBLICATIONS

Robinson et al, "Reducing Residual Stress in 7050 Aluminum Alloy Die Forgings by Heat Treatment", 2008. Journal of Engineering Materials and Technology, vol. 130, pp. 1-8 (Year: 2008).*
(Continued)

*Primary Examiner* — Keith Walker
*Assistant Examiner* — Benjamin C Anderson
(74) *Attorney, Agent, or Firm* — Thomas Horstemeyer, LLP

(57) ABSTRACT

A method for manufacturing a cold-forged, extruded aluminum alloy tube includes: providing a primary material made of an aluminum alloy material, and a first cold extrusion apparatus; processing the primary material to form a preform; subjecting the preform to a homogeneous annealing by heating to a temperature of about 410° C. to 510° C. and then cooling to a temperature of about 160° C. to 200° C.; testing the hardness of the preform; immersing the preform in a lubricant which is a lipid having a viscosity index equal to or greater than 170, a flash point equal to or greater than 240° C., a pour point equal to or greater than −24° C., and a fire point equal to or greater than 255° C.; and subjecting the preform to cold extrusion.

14 Claims, 5 Drawing Sheets

(51) Int. Cl.
*C22F 1/043* (2006.01)
*C22F 1/053* (2006.01)

(58) Field of Classification Search
CPC ..... B21C 23/01; B21C 23/02; B21C 23/03; B21C 23/035; B21C 23/04; B21C 23/08; B21C 23/085; B21C 25/02; B21C 25/08; B21C 26/00; B21C 37/30; C22F 1/04; C22F 1/043; C22F 1/05; C22F 1/053; C22C 21/00; C22C 21/02; C22C 21/04; C22C 21/06; C22C 21/08; C22C 21/10
See application file for complete search history.

(56) References Cited

U.S. PATENT DOCUMENTS

2004/0144152 A1* 7/2004 Wu ..... B62K 19/06 72/370.06
2007/0293405 A1* 12/2007 Zhang ..... C10M 103/02 508/113
2019/0161851 A1* 5/2019 Morii ..... C22F 1/16
2019/0351475 A1* 11/2019 Yao ..... B21J 9/08
2021/0053099 A1* 2/2021 Lin ..... C21D 1/55

FOREIGN PATENT DOCUMENTS

JP 2007284731 A * 11/2007
KR 20170061731 A * 6/2017

OTHER PUBLICATIONS

"Aluminium/Aluminium 6066 Alloy", 2014. Azom (Year: 2014).*
Hirsch, "Annealing of Aluminum and Its Alloys", 2016. ASM Handbook, vol. 4E, pp. 137-147. (Year: 2016).*
Karunathilaka et al., "Effect of contact pressure applied on tool surface during cold forging on fatigue life of tool steel", 2018. Procedia Manufacturing, vol. 15, pp. 488-495. (Year: 2018).*

* cited by examiner

METHOD FOR MANUFACTURING COLD-FORGED, EXTRUDED ALUMINUM ALLOY TUBE

CROSS-REFERENCE TO RELATED APPLICATION

This application claims priority of Taiwanese Patent Application Nos. 108112355 and 108145162, filed on Apr. 9, 2019 and Dec. 10, 2019, respectively.

FIELD

The disclosure relates to a method for manufacturing a cold-forged, extruded aluminum alloy tube by cold forging and cold extrusion.

BACKGROUND

Taiwanese Utility Model Patent Publication No. 564857 discloses a connecting structure of an upright tube and a front fork of a bicycle, in which a handlebar is inserted into one end of the upright tube, and the front fork is inserted into the other end of the upright tube.

The upright tube is generally made by hot forging and hot extrusion in response to the shape and structural strength requirements. Specifically, a material subjected to hot forging and hot extrusion is first heated in a furnace to a temperature above the recrystallization temperature, followed by a processing step for shaping. Hot forging and hot extrusion not only require a furnace that can withstand high temperature and a material-taking equipment, but also incur a high capital expenditure due to quick wearing of the hot forging and hot extrusion dies and large consumption of energy.

SUMMARY

Therefore, an object of the present disclosure is to provide a method for manufacturing a cold-forged, extruded aluminum alloy tube that can alleviate at least one of the drawbacks of the prior art.

According to the present disclosure, a method for manufacturing a cold-forged, extruded aluminum alloy tube includes the steps of:

(A) providing a primary material having a hollow columnar shape and made of an aluminum alloy material, and a first cold extrusion apparatus including a first cold extrusion die, and a first ram and a first plunger corresponding in position to the first cold extrusion die, the first plunger extending downwardly from the first ram;

(B) processing the primary material to form a preform that extends along an axis and that has a first end surface and a second end surface opposite to each other along the axis, an inner circumferential surface between the first end surface and the second end surface and defining a central bore, and an outer circumferential surface opposite to the inner circumferential surface, the preform further having an original length extending from the first end surface to the second end surface, and an original outer diameter measured across the outer circumferential surface, each of the first end surface, the second end surface and the outer circumferential surface having a surface roughness controlled at equal to or less than 0.4 μm Ra, each of the original outer diameter and the original length having a tolerance of equal to or less than 0.01 mm;

(C) subjecting the preform to a homogeneous annealing which involves heating the preform in a furnace to a temperature of about 410° C. to 510° C., and then removing the preform from the furnace after the furnace is cooled to a temperature of about 160° C. to 200° C. at a cooling rate of 10° C. per hour;

(D) testing the hardness of the preform, the hardness being 60±5 degrees measured on Rockwell Hardness F scale;

(E) immersing the preform in a tank containing a lubricant for a predetermined time, the lubricant is a lipid having a viscosity index equal to or greater than 170, a flash point equal to or greater than 240° C., a pour point equal to or greater than −24° C., and a fire point equal to or greater than 255° C.; and (F) subjecting the preform to cold extrusion which involves positioning the preform in the first cold extrusion die, after which the first cold extrusion apparatus is operated to strike the first ram against the preform with the first plunger extending through the central bore of the preform to thereby form the cold-forged, extruded aluminum alloy tube, the cold-forged, extruded aluminum alloy tube having a first end surface and a second end surface opposite to each other, an outer circumferential surface between the first end surface and the second end surface of the cold-forged, extruded aluminum alloy tube, and an inner circumferential surface opposite to the outer circumferential surface of the cold-forged, extruded aluminum alloy tube and defining a central bore, the cold-forged, extruded aluminum alloy tube having a length that extends between the first end surface and the second end surface of the cold-forged, extruded aluminum alloy tube and that is longer than the original length of the preform.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
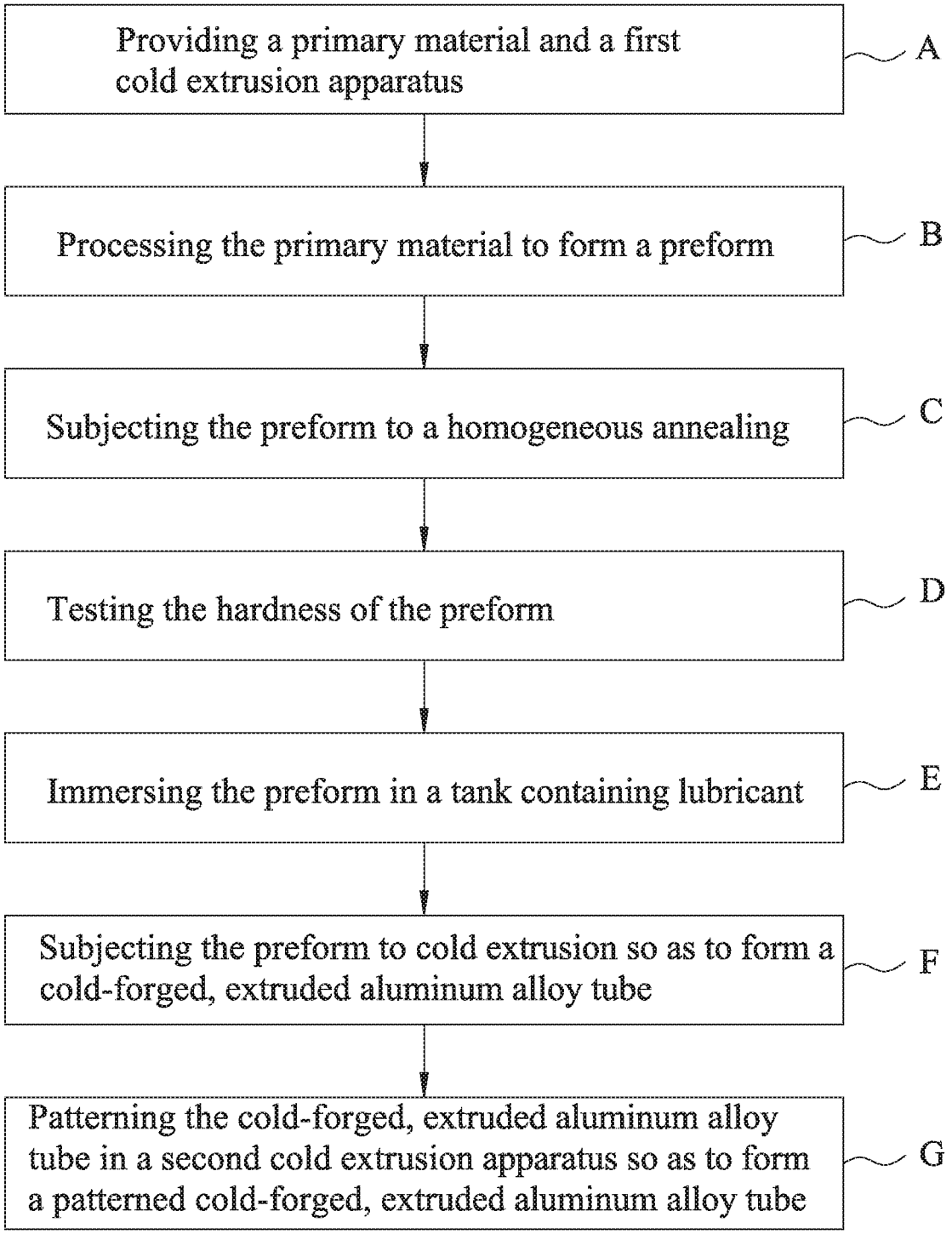
FIG. 1 is a flow chart, illustrating the steps involved in a method for manufacturing a cold-forged, extruded aluminum alloy tube according to an embodiment of the present disclosure.

Referring to FIG. 1, a method for manufacturing a cold-forged, extruded aluminum alloy tube according to an embodiment the present disclosure includes steps A to G.

Figure 2:
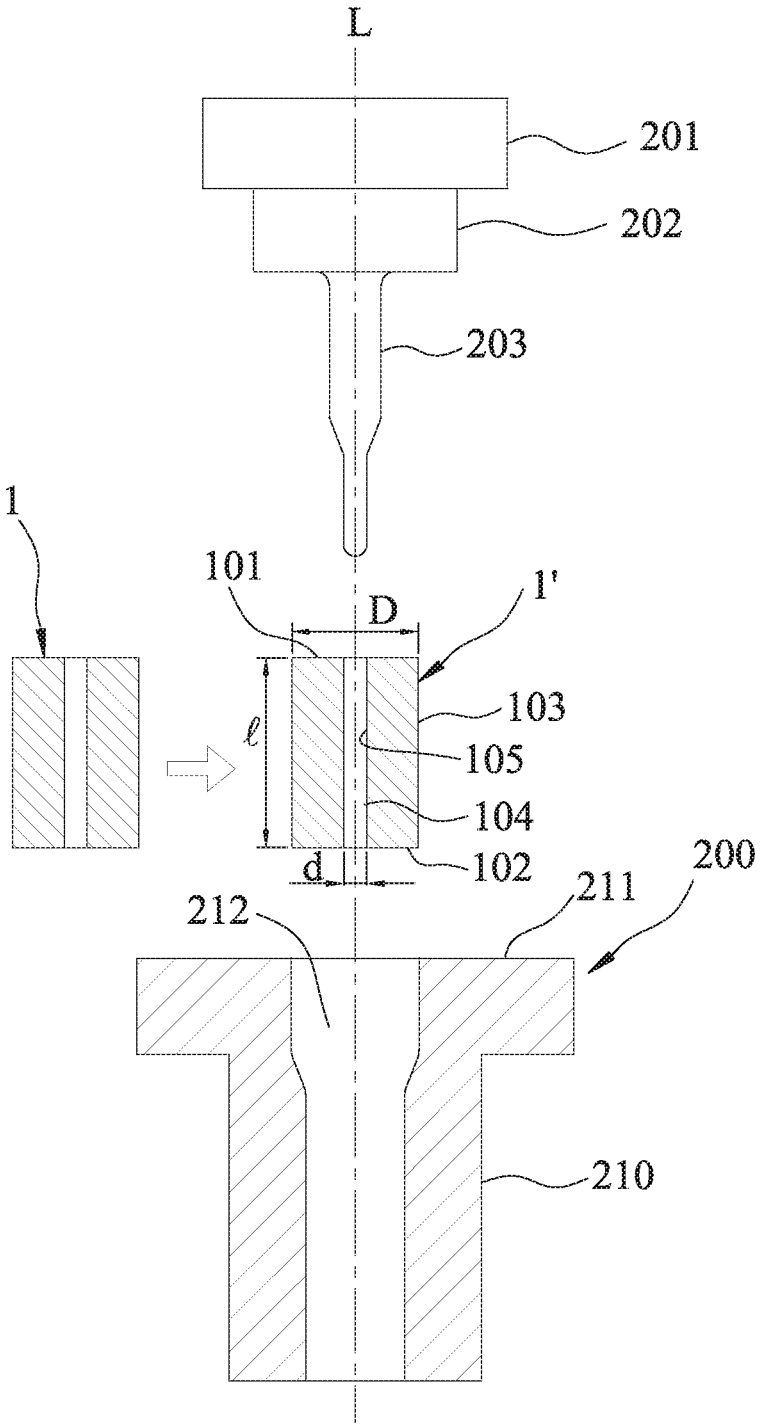
FIG. 2 is an exploded cross-sectional view of a preform and a first cold extrusion apparatus of the embodiment.
Figure 4:
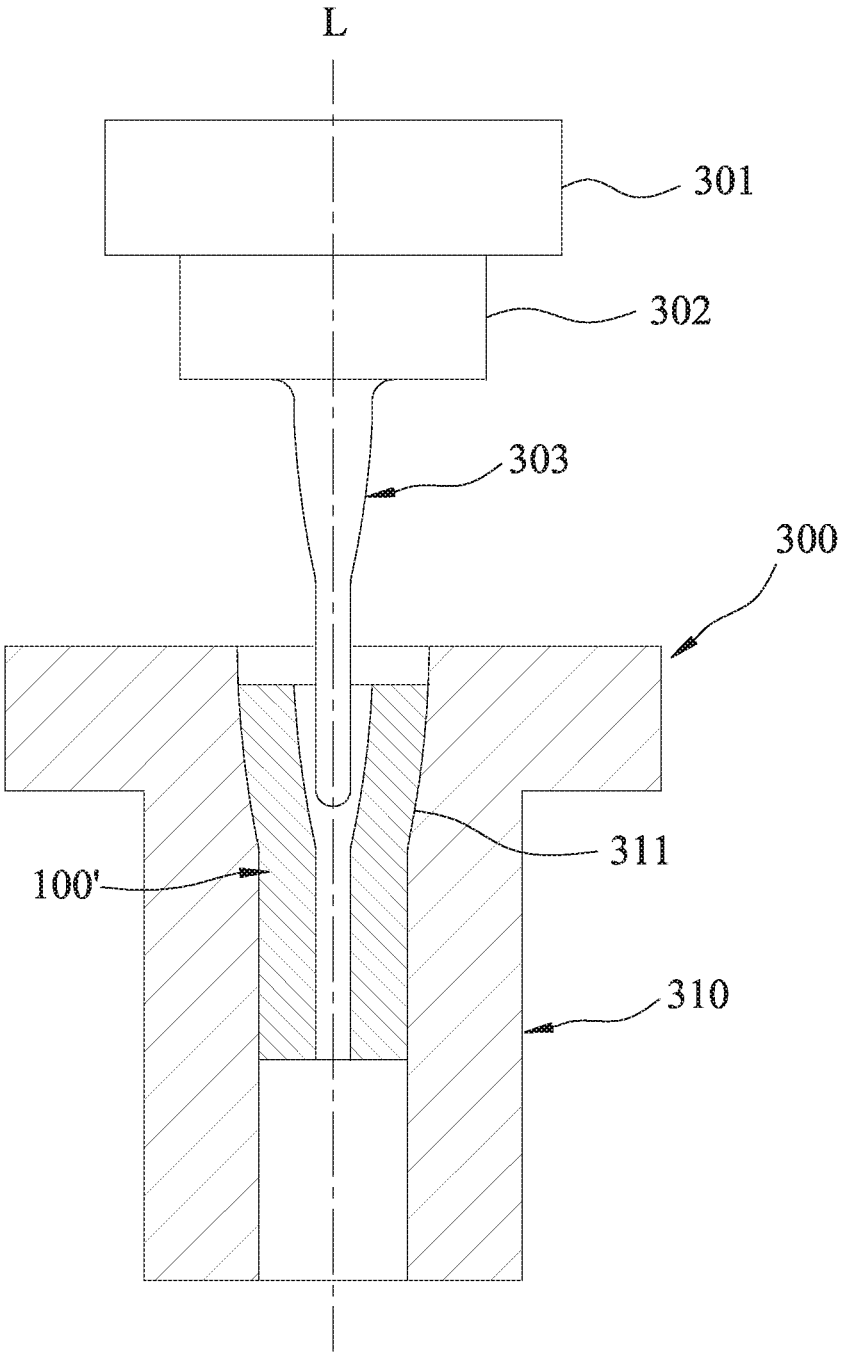
FIG. 4 is a cross-sectional view of a second cold extrusion apparatus of the embodiment.

In step A, referring to FIGS. 2 and 4, in combination with FIG. 1, a primary material 1, a first cold extrusion apparatus 200 and a second cold extrusion apparatus 300 are provided. The primary material 1 has a hollow columnar shape, and is made of an aluminum alloy material, such as, but is not limited to, AL6066 aluminum alloy, and AL7050 aluminum alloy. The first cold extrusion apparatus 200 includes a first cold extrusion die 210, a first fixing seat 201 movably disposed above the cold extrusion die 210, a first ram 202 fixed to the first fixing seat 201, and a first plunger 203 extending downwardly from the first ram 202. The first ram 202 and the first plunger 203 correspond in position to the first cold extrusion die 210. The first cold extrusion die 210 has a top surface 211 and a first die cavity 212 extending inwardly and downwardly from the top surface 211. In this embodiment, the first die cavity 212 has a stepped shape and tapers from top to bottom. Further, the first plunger 203 also has a stepped shape, and tapers from top to bottom. The step portion and the corner of the first plunger 203 are made arcuate in shape. The second cold extrusion apparatus 300 includes a second cold extrusion die 310, a second fixing seat 301 movably disposed above the second cold extrusion die 310, a second ram 302 fixed to the second fixing seat 301, and a second plunger 303 extending downwardly from the second ram 302. The second ram 302 and the second plunger 303 correspond in position to the second cold extrusion die 310. The second cold extrusion die 310 has a second die cavity 311 that extends inwardly and downwardly from a top surface thereof, that has a stepped shape and that tapers from top to bottom. The second plunger 303 also has a stepped shape, and tapers from top to bottom. The step portion and the corner of the second plunger 303 are made arcuate in shape.

In step B, with reference to FIG. 2, the primary material 1 is processed to form a preform 1' having a hollow cylindrical shape. The preform 1' extends along an axis (L), and has a first end surface 101 and a second end surface 102 opposite to each other along the axis (L), an outer circumferential surface 103 between the first end surface 101 and the second end surface 102, and an inner circumferential surface 105 opposite to the outer circumferential surface 103 and defining a central bore 104. The preform 1' further has an original length (l) extending from the first end surface 101 to the second end surface 102, an original outer diameter (D) measured across the outer circumferential surface 103, and an original inner diameter (d) measured across the inner circumferential surface 105. Each of the first end surface 101, the second end surface 102, the outer circumferential surface 103 and the inner circumferential surface 105 has a surface roughness controlled at equal to or less than 0.4 μm Ra. Each of the original outer diameter (D), the original inner diameter (d) and the original length (l) has a tolerance of equal to or less than 0.01 mm.

In step C, the preform is subjected to a homogeneous annealing which involves heating the preform 1' in a furnace to a temperature of about 410° C. to 510° C., and then removing the preform 1' from the furnace after the furnace is cooled to a temperature of about 160° C. to 200° C. at a cooling rate of 10° C. per hour.

In step D, the hardness of the preform 1' is tested. The hardness of the preform 1' should be 60±5 degrees measured on Rockwell Hardness F scale. The testing of the hardness of the preform 1' is performed at multiple points of the outer circumferential surface 103 and at equal intervals along the axis (L), and at multiple points of the inner circumferential surface 105 and at equal intervals along the axis (L).

In step E, the preform 1' is immersed in a tank containing a lubricant (not shown) for a predetermined time. In this embodiment, the lubricant used is a lipid which has a viscosity index equal to or greater than 170, a flash point equal to or greater than 240° C., a pour point equal to or greater than −24° C., and a fire point equal to or greater than 255° C. The predetermined time for immersing the preform 1' in the tank containing the lubricant depends on the number of the preform 1'. When the number of the preform 1' immersed is one, the predetermined time is 4 to 5 minutes, and when the number of the preform 1' immersed is plural, the predetermined time is 25 to 35 minutes.

Figure 3:
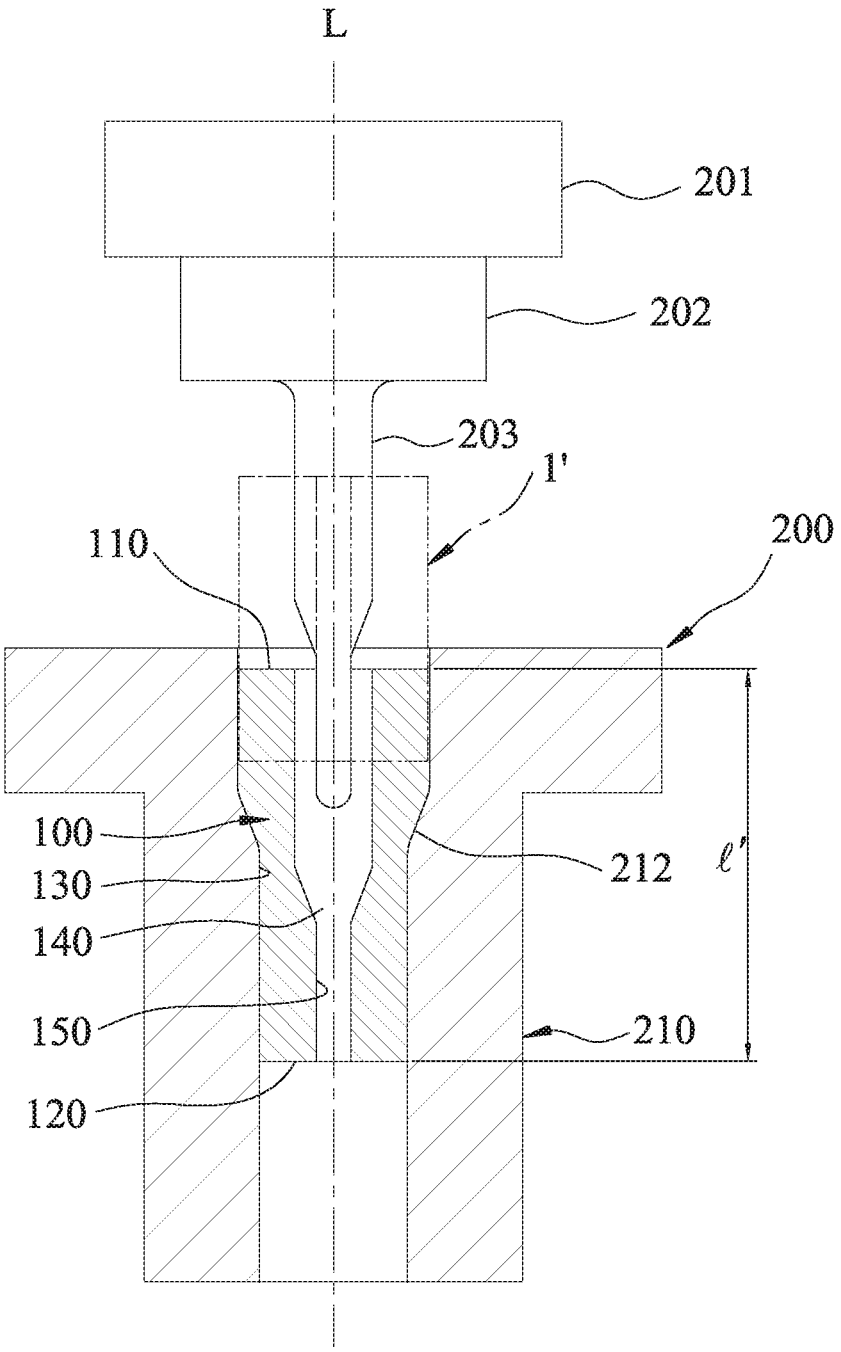
FIG. 3 is a cross-sectional view, illustrating how the preform is formed into the cold-forged, extruded aluminum alloy tube of the embodiment.

In step F, referring to FIG. 3, the preform 1' that has been immersed in the lubricant is subjected to cold extrusion which is conducted at room temperature and which involves positioning the preform 1' in the first die cavity 212, after which, the first cold extrusion apparatus 200 is operated to strike the first ram 202 against the preform 1' with the first plunger 203 extending through the central bore 104 of the preform 1' to thereby form the cold-forged, extruded aluminum alloy tube 100. The cold-forged, extruded aluminum alloy tube 100 has a hollow tubular shape, and extends along the axis (L). The cold-forged, extruded aluminum alloy tube 100 has a first end surface 110 and a second end surface 120 opposite to each other along the axis (L), an outer circumferential surface 130 between the first end surface 110 and the second end surface 120, and an inner circumferential surface 150 opposite to the outer circumferential surface 130 and defining a central bore 140. The central bore 140 is parallel to the axis (L), and has a contour corresponding to that of the first plunger 203. The cold-forged, extruded aluminum alloy tube 100 further has a length (l') that extends between the first end surface 110 and the second end surface 120 and that is longer than the original length (l) of the preform 1'.

In step G, as shown in FIGS. 3 and 4, the cold-forged, extruded aluminum alloy tube 100 is positioned in the second die cavity 311, after which the second cold extrusion apparatus 300 is operated to strike the second ram 302 against the cold-forged, extruded aluminum alloy tube 100 with the second plunger 303 extending through the central bore 140 of the cold-forged, extruded aluminum alloy tube 100 to thereby form a patterned cold-forged, extruded aluminum alloy tube 100'.

Thus, by utilizing the above-mentioned Steps A to G of the present disclosure, the primary material 1 can be cold-extruded to form the patterned cold-forged, extruded aluminum alloy tube 100'. The patterned cold-forged, extruded aluminum alloy tube 100' is free from defects caused by metal heating, and has several advantageous characteristics, such as high precision and surface quality, an enhanced hardness and strength, and a large deformation resistance. That is, by processing the primary material 1 to form the preform 1' in step B, the surface roughness of each of the first end surface 101, the second end surface 102, the outer circumferential surface 103 and the inner circumferential surface 105 of the preform 1' is controlled to be equal to or less than 0.4 μm Ra, and each of the original outer diameter (D), the original inner diameter (d) and the original length (l) of the preform 1' has a tolerance of equal to or less than 0.01 mm, so that the cold-forged, extruded aluminum alloy tube 100 is not required to undergo precision machining of its surfaces. Further, the first cold extrusion apparatus 200 and the second cold extrusion apparatus 300 are not easily worn out. Followed by the homogeneous annealing in step C, the plasticity of the preform 1' can be improved. By utilizing the subsequent cold extrusion step, that is, step F, residual stress of the cold-forged, extruded aluminum alloy tube 100 can be reduced, and the homogenization of the composition and structure thereof can be improved. Moreover, by utilizing the lubricant in step (B), the preform 1' is provided with an improved lubricating effect for subsequent cold extrusion.

Therefore, the method for manufacturing the cold-forged, extruded aluminum alloy tube 100 of the present disclosure does not need to be provided with high temperature hot forging and hot extrusion equipment, and material-taking equipment. In addition, by utilizing the processing step of step B, not only does the cold-forged, extruded aluminum alloy tube 100 achieve a high precision, but also the wear out of the first cold extrusion apparatus 200 and the second cold extrusion apparatus 300 can be reduced so as to extend the service life thereof. Furthermore, overall energy consumption may be reduced, which may result in low capital expenditure.

It is worth mentioning that, step G may be omitted when the intended usage of the cold-forged, extruded aluminum alloy tube 100 is achieved. In other words, step G is conducted only when patterning of the cold-forged, extruded aluminum alloy tube 100 is required.

Figure 5:
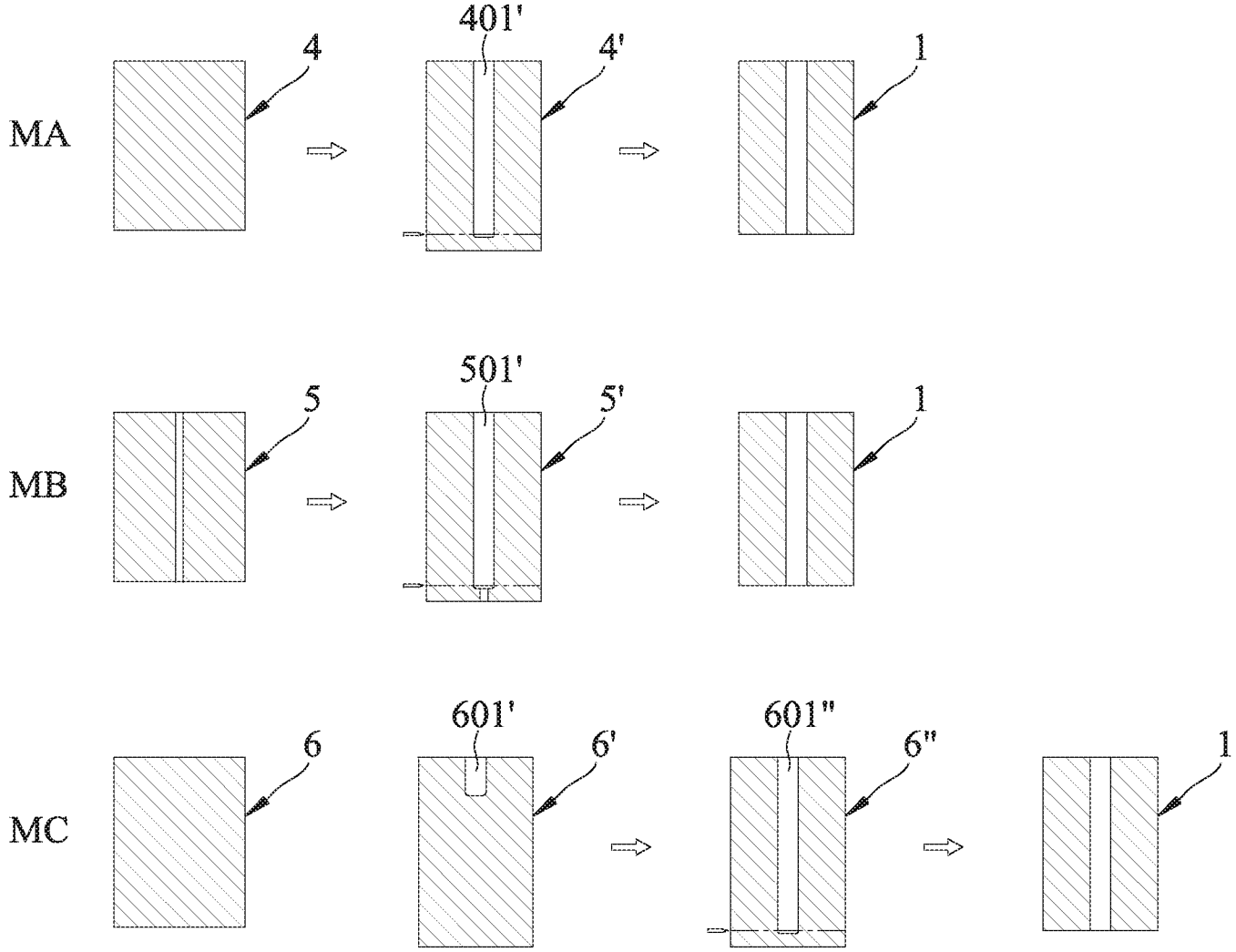
FIG. 5 illustrates three different ways of forming a primary material of the embodiment.

Moreover, referring to FIG. 5, the primary material 1 provided in step A can be made using one of the following methods: Method A, Method B and Method C. Method A, Method B and Method C are respectively denoted by MA, MB and MC in FIG. 5.

In Method A (MA), a cylindrical blank 4 is processed using a computer numerically controlled (CNC) machine to make the size and surface roughness of the cylindrical blank 4 reach a predetermined precision. Next, the cylindrical blank 4 is subjected to cold forging using a cold forging apparatus (not shown) to obtain a cold-forged blank 4' having a U-shaped groove 401' with a blind end. Then, the blind end of the groove 401' of the cold-forged blank 4' is cut to obtain the primary material 1 having the hollow columnar shape.

In Method B (MB), a hollow cylindrical blank 5 is processed using the CNC machine to make the size and surface roughness of the cylindrical blank 5 reach a predetermined precision. Next, the cylindrical blank 5 is subjected to cold forging using a cold forging apparatus (not shown) to obtain a cold-forged blank 5' having a stepped hole 501'. Then, a small diameter portion and a part of a large diameter portion adjacent to the small diameter portion of the stepped hole 501' of the cold-forged blank 5' are cut to obtain the primary material 1 having the hollow columnar shape.

In Method C (MC), a cylindrical blank 6 is subjected to a first processing using the CNC machine, Next, the cylindrical blank 6 is subjected to cold forging using a first cold-forging apparatus (not shown) to obtain a first cold-forged blank 6' having a U-shaped groove 601' that is shallow. Then, the first cold-forged blank 6' is subjected to a second processing using the CNC machine to make the size and surface roughness of the cold-forged blank 6' reach a predetermined precision (i.e., size calibration). Afterwards, the first cold-forged blank 6' is subjected to a second cold forging operation using a second cold forging apparatus (not shown) to obtain a second cold-forged blank 6" having a U-shaped groove 601" that is deeper that the groove 601' and that has a blind end. Finally, the blind end of the groove 601" of the second cold-forged blank 6" is cut to obtain the primary material 1 having the hollow columnar shape.

In summary, by virtue of the method for manufacturing the cold-forged, extruded aluminum alloy tube 100 of the present disclosure, which has simple processing steps and equipments, and is energy-saving, the capital expenditure thereof can be effectively reduced and the quality of the thus obtained cold-forged, extruded aluminum alloy tube 100 can be improved.

While the present disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A method for manufacturing a cold-forged, extruded aluminum alloy tube having two opposite open ends, consisting of the steps of:

(A) providing a primary material having a hollow columnar shape and made of an aluminum alloy material, and a first cold extrusion apparatus including a first cold extrusion die, and a first ram and a first plunger corresponding in position to the first cold extrusion die, the first plunger extending downwardly from the first ram;

(B) processing the primary material to form a preform that extends along an axis and that has a first end surface and a second end surface opposite to each other along the axis after step (A), an inner circumferential surface between the first end surface and the second end surface and defining a central bore, and an outer circumferential surface opposite to the inner circumferential surface, the preform further having an original length extending from the first end surface to the second end surface, and an original outer diameter measured across the outer circumferential surface, each of the first end surface, the second end surface and the outer circumferential surface having a surface roughness controlled at equal to or less than 0.4 μm Ra, each of the original outer diameter and the original length having a tolerance of equal to or less than 0.01 mm;

(C) subjecting the preform to a homogeneous annealing after step (B), the homogeneous annealing involving heating the preform in a furnace to a temperature of about 410° C. to 510° C., and then removing the preform from the furnace after the furnace is cooled to a temperature of about 160° C. to 200° C. at a cooling rate of 10° C. per hour;

(D) testing the hardness of the preform after step (C), the hardness being 60±5 degrees measured on Rockwell Hardness F scale;

(E) immersing the preform in a tank containing a lubricant for a predetermined time after step (D), the lubricant being a lipid having a viscosity index equal to or greater than 170, a flash point equal to or greater than 240° C., a pour point equal to or greater than −24° C., and a fire point equal to or greater than 255° C.; and (F) subjecting the preform to cold extrusion which involves positioning the preform in the first cold extrusion die after step (E), and then the first cold extrusion apparatus is operated to strike the first ram against the preform with the first plunger extending through the central bore of the preform to thereby form the cold-forged, extruded aluminum alloy tube, the cold-forged, extruded aluminum alloy tube having a first end surface and a second end surface opposite to each other, an outer circumferential surface between the first end surface and the second end surface of the cold-forged, extruded aluminum alloy tube, and an inner circumferential surface opposite to the outer circumferential surface of the cold-forged, extruded aluminum alloy tube and defining a central bore, the cold-forged, extruded aluminum alloy tube having a length that extends between the first end surface and the second end surface of the cold-forged, extruded aluminum alloy tube and that is longer than the original length of the preform.

2. The method as claimed in claim 1, wherein in step (D), the testing of the hardness of the preform is performed at multiple points of the outer circumferential surface of the preform and at equal intervals along the axis.

3. The method as claimed in claim 1, wherein in step (B), the preform has a hollow cylindrical shape.

4. The method as claimed in claim 3, wherein in step (D), the testing of the hardness of the preform is performed at multiple points of the outer circumferential surface and the inner circumferential surface of the preform and at equal intervals along the axis.

5. The method as claimed in claim 1, wherein the primary material provided in step (A) is made of AL6066 aluminum alloy.

6. The method as claimed in claim 1, wherein the primary material provided in step (A) is made of AL7050 aluminum alloy.

7. The method as claimed in claim 1, wherein the predetermined time in step (E) is 4 to 5 minutes.

8. A method for manufacturing a cold-forged, extruded aluminum alloy tube having two opposite open ends, consisting of the steps of:

(A) providing a primary material having a hollow columnar shape and made of an aluminum alloy material, and a first cold extrusion apparatus including a first cold extrusion die, and a first ram and a first plunger corresponding in position to the first cold extrusion die, the first plunger extending downwardly from the first ram, and providing a second cold extrusion apparatus, the second cold extrusion apparatus including a second cold extrusion die, a second ram and a second plunger corresponding in position to the second cold extrusion die, the second plunger extending downwardly from the second ram, (B) processing the primary material to form a preform that extends along an axis and that has a first end surface and a second end surface opposite to each other along the axis after step (A), an inner circumferential surface between the first end surface and the second end surface and defining a central bore, and an outer circumferential surface opposite to the inner circumferential surface, the preform further having an original length extending from the first end surface to the second end surface, and an original outer diameter measured across the outer circumferential surface, each of the first end surface, the second end surface and the outer circumferential surface having a surface roughness controlled at equal to or less than 0.4 μm Ra, each of the original outer diameter and the original length having a tolerance of equal to or less than 0.01 mm;

(C) subjecting the preform to a homogeneous annealing after step (B), the homogeneous annealing involving heating the preform in a furnace to a temperature of about 410° C. to 510° C., and then removing the preform from the furnace after the furnace is cooled to a temperature of about 160° C. to 200° C. at a cooling rate of 10° C. per hour;

(D) testing the hardness of the preform after step (C), the hardness being 60±5 degrees measured on Rockwell Hardness F scale;

(E) immersing the preform in a tank containing a lubricant for a predetermined time after step (D), the lubricant being a lipid having a viscosity index equal to or greater than 170, a flash point equal to or greater than 240° C., a pour point equal to or greater than −24° C., and a fire point equal to or greater than 255° C.;

(F) subjecting the preform to cold extrusion which involves positioning the preform in the first cold extrusion die after step (E), and then the first cold extrusion apparatus is operated to strike the first ram against the preform with the first plunger extending through the central bore of the preform to thereby form the cold-forged, extruded aluminum alloy tube, the cold-forged, extruded aluminum alloy tube having a first end surface and a second end surface opposite to each other, an outer circumferential surface between the first end surface and the second end surface of the cold-forged, extruded aluminum alloy tube, and an inner circumferential surface opposite to the outer circumferential surface of the cold-forged, extruded aluminum alloy tube and defining a central bore, the cold-forged, extruded aluminum alloy tube having a length that extends between the first end surface and the second end surface of the cold-forged, extruded aluminum alloy tube and that is longer than the original length of the preform; and (G) after step (F), positioning the cold-forged, extruded aluminum alloy tube in the second cold extrusion die, after which the second cold extrusion apparatus is operated to strike the second ram against the cold-forged, extruded aluminum alloy tube with the second plunger extending through the central bore of the cold-forged, extruded aluminum alloy tube to thereby form a patterned cold-forged, extruded aluminum alloy tube.

9. The method as claimed in claim 8, wherein in step (D), the testing of the hardness of the preform is performed at multiple points of the outer circumferential surface of the preform and at equal intervals along the axis.

10. The method as claimed in claim 8, wherein in step (B), the preform has a hollow cylindrical shape.

11. The method as claimed in claim 10, wherein the testing of the preform is performed at multiple points of the outer circumferential surface and the inner circumferential surface of the preform and at equal intervals along the axis.

12. The method as claimed in claim 8, wherein the primary material provided in step (A) is made of AL6606 aluminum alloy.

13. The method as claimed in claim 8, wherein the primary material provided in step (A) is made of AL7050 aluminum alloy.

14. The method as claimed in claim 8, wherein the predetermined time in step (E) is 4 to 5 minutes.

* * * * *